US007073876B2

(12) United States Patent
Wing et al.

(10) Patent No.: US 7,073,876 B2
(45) Date of Patent: Jul. 11, 2006

(54) EXCHANGEABLE COMPONENTS FOR COLOR CUSTOMIZING OF APPLIANCES

(75) Inventors: Forrest F. Wing, Des Moines, IA (US); Michael J. Eveland, Cedar Rapids, IA (US); Todd E. Kniffen, Williamsburg, IA (US); Thomas E. Gose, Cedar Rapids, IA (US); Ravi Kumar Sawhney, Calabasas, CA (US); Timothy Mark Nugent, Venice, CA (US); John Frank Zinni, Capistrano Beach, CA (US)

(73) Assignee: Maytag Corporation, Newton, IA (US)

( * ) Notice: Subject to any disclaimer, the term of this patent is extended or adjusted under 35 U.S.C. 154(b) by 453 days.

(21) Appl. No.: 10/195,191

(22) Filed: Jul. 15, 2002

(65) Prior Publication Data

US 2004/0007009 A1 Jan. 15, 2004

(51) Int. Cl.
*A47B 97/00* (2006.01)

(52) U.S. Cl. ..... 312/204; 312/405.1

(58) Field of Classification Search ..... 312/204, 312/404, 405, 405.1, 408, 351
See application file for complete search history.

(56) References Cited

U.S. PATENT DOCUMENTS 2,186,683 A 1/1940 Raymond
2,680,642 A * 6/1954 Koeber et al. ..... 292/347
2,720,683 A 10/1955 Schwenker et al.
2,760,301 A 8/1956 Derr et al.
2,787,035 A * 4/1957 Konefes ..... 52/718.02
2,973,235 A 2/1961 Saunders
3,500,507 A * 3/1970 Malhenzie et al. ..... 24/113 MP
3,556,622 A * 1/1971 Rubin et al. ..... 312/195
3,766,598 A 10/1973 Roberts
4,087,141 A 5/1978 Roberts
4,357,734 A * 11/1982 Moore ..... 16/442
4,732,431 A * 3/1988 Mason ..... 312/109
4,745,656 A 5/1988 Revlett
4,858,783 A * 8/1989 Mayfield, III ..... 221/59
4,862,642 A 9/1989 Alessi
4,923,260 A * 5/1990 Poulsen ..... 312/408
4,926,523 A 5/1990 Carlson et al.
4,960,308 A * 10/1990 Donaghy ..... 312/404
5,158,346 A * 10/1992 Marks et al. ..... 312/204
5,303,451 A * 4/1994 Graviss et al. ..... 16/412
5,355,554 A 10/1994 Magoon
5,358,326 A 10/1994 Cherry et al.
5,493,756 A 2/1996 Shanok et al.
5,526,854 A * 6/1996 Unger ..... 141/351
5,659,927 A 8/1997 Shanok et al.
5,671,987 A * 9/1997 Hommes ..... 312/334.23
5,771,537 A * 6/1998 Ho ..... 16/410
5,813,245 A * 9/1998 Coates et al. ..... 62/338
5,951,134 A * 9/1999 Braun et al. ..... 312/405.1

(Continued)

FOREIGN PATENT DOCUMENTS

DE 3304034 A1 8/1984

(Continued)

*Primary Examiner*—Janet M. Wilkens
(74) *Attorney, Agent, or Firm*—McKee, Voorhees & Sease, P.L.C.

(57) ABSTRACT

An appliance, such as a refrigerator, is provided with a door handle with colored caps for covering the door handle fasteners. The caps are exchangeable with other caps having different colors, as chosen by the consumer. The refrigerator also includes storage buckets, shelves and drawers with colored trim pieces which are exchangeable with different colored trim pieces, as well as a water dispenser having a colored actuation button and a colored sump tray, both of which can be exchanged with different colored buttons and trays.

14 Claims, 4 Drawing Sheets

U.S. PATENT DOCUMENTS

| | | | | |
|---|---|---|---|---|
| 6,170,144 | B1 * | 1/2001 | Phillipson | 29/453 |
| 6,336,414 | B1 * | 1/2002 | Stewart et al. | 108/50.02 |
| 6,422,673 | B1 * | 7/2002 | Bienick | 312/408 |

FOREIGN PATENT DOCUMENTS

| | | | |
|---|---|---|---|
| DE | 40 01 571 | * | 7/1991 |
| GB | 2165743 | A | 9/1984 |
| JP | 405093582 | A | 4/1993 |
| JP | 405093583 | A | 4/1993 |
| JP | 406347158 | A | 12/1994 |
| JP | 407055328 | A | 3/1995 |
| JP | 407294107 | A | 11/1995 |

* cited by examiner 26
20
20
5
5
26

Fig. 4
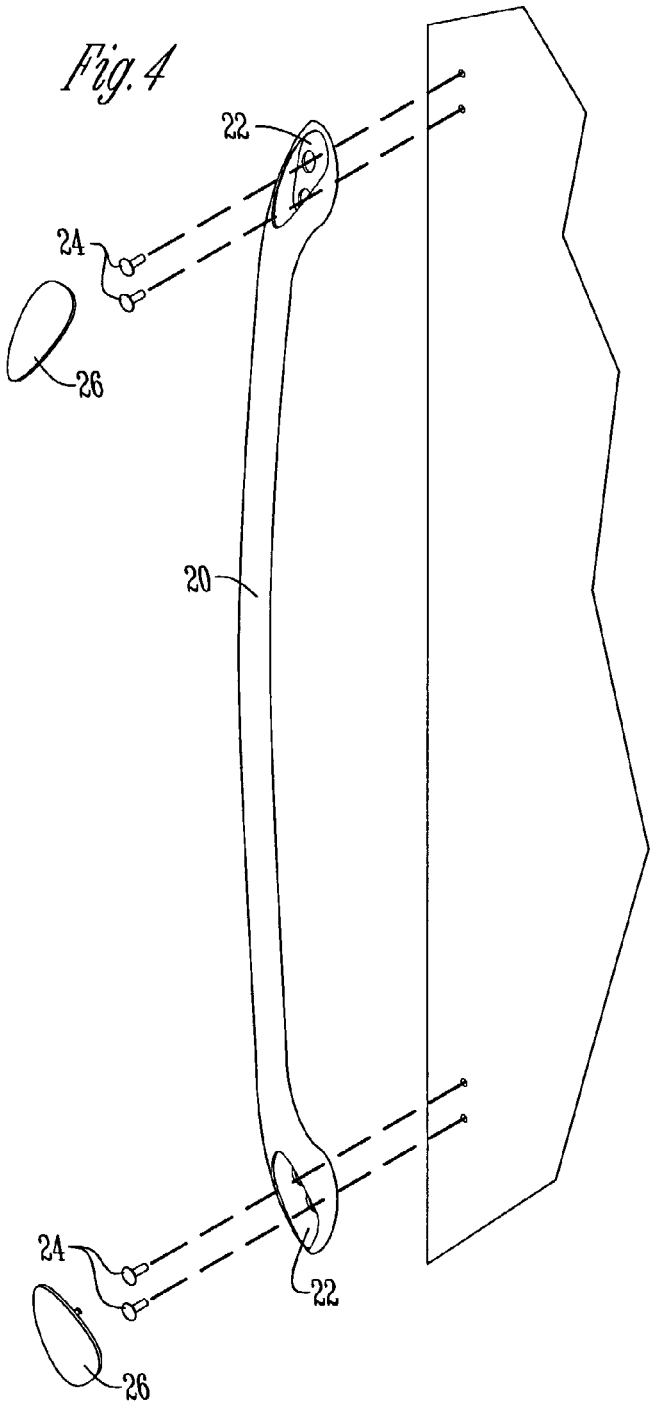
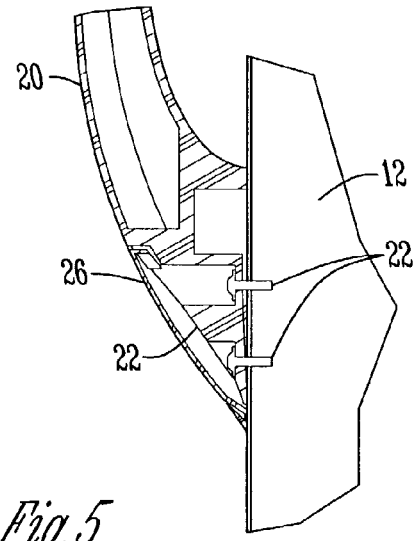
Fig. 5

EXCHANGEABLE COMPONENTS FOR COLOR CUSTOMIZING OF APPLIANCES

BACKGROUND OF THE INVENTION

Appliances, such as refrigerators, are typically marketed with a very limited selection of monochromatic exterior colors. In contrast, the environments in which the appliances are installed typically include extensive color and pattern. Consumers appreciate and desire a multitude of color options, which generally are not available for appliances. On the other hand, manufacturers seek to limit variety and variability in mass produced products, such as appliances. Thus, there is a need for appliance products which meet both the manufacturer's goal and the consumer's wishes.

Accordingly, a primary objective of the present invention is the provision of improved appliances having color coordinated pieces which can be exchanged with other pieces having different colors.

Another objective of the present invention is the provision of a refrigerator having a door handle with interchangeable colored fastener caps.

Another objective of the present invention is the provision of a refrigerator having a water dispenser with an interchangeable colored sump tray and actuator buttons.

Still another objective of the present invention is the provision of a refrigerator having storage buckets, drawers and shelves with colored trim pieces which can be exchanged with other trim pieces having different colors.

A further objective of the present invention is the provision of mass produced appliances having a limited variety with a maximum of color decorating choices for the consumer.

These and other objectives will become apparent from the following description of the invention.

SUMMARY OF THE INVENTION

The present invention is directed towards appliances having a door with a handle, with color coordinated caps for covering the door handle mounting screws or fasteners, wherein the caps can be exchanged with other caps having different colors, as selected by the consumer. In the case of a refrigerator, the invention is also directed toward color coordinated trim pieces on the storage buckets or bins, drawers and shelves in the food compartment, which can be interchanged with different colored trim pieces to provide a consumer color choice. For refrigerators having an exterior water dispenser, the invention also includes a color coordinated sump tray and actuator button on the dispenser, both of which can be exchanged with other trays and actuator buttons having different colors.

BRIEF DESCRIPTION OF THE DRAWINGS

FIG. 4 is an exploded view of the refrigerator door handle with colored caps.

FIG. 5 is a sectional view of the door cap taken along lines 5—5 of FIG. 3.

DETAILED DESCRIPTION OF THE INVENTION

Figure 1:
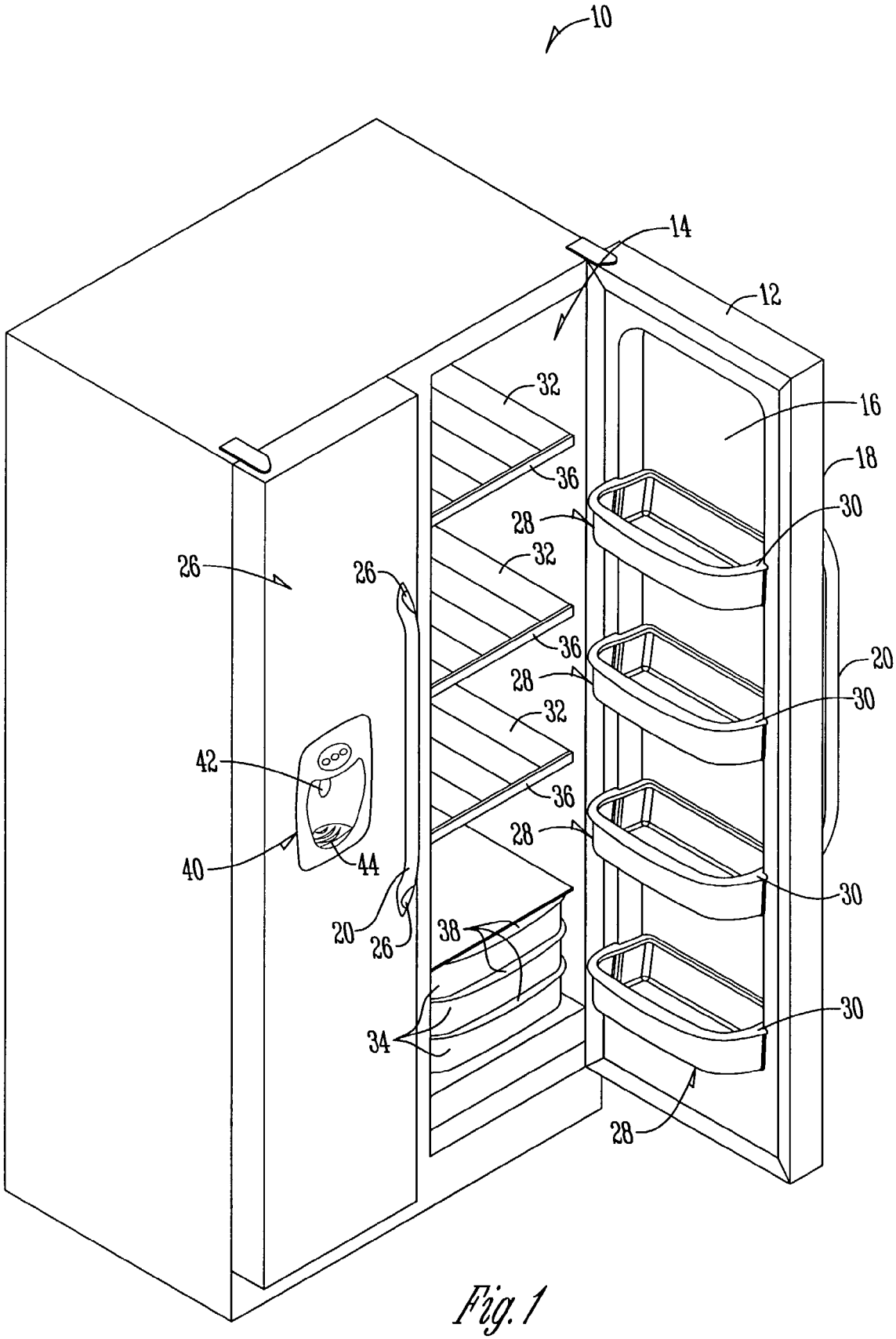
FIG. 1 is a perspective view of a refrigerator having the exchangeable color pieces of the present invention on the door handles, storage buckets, drawers, shelves and water dispenser.

In the drawings, a refrigerator is generally designated by the reference numeral 10. The refrigerator 10 includes doors 12 movable between open and closed positions relative to the internal food compartments 14. The doors 12 include an interior surface 16 and an exterior surface 18.

A handle 20 is mounted on the exterior surface 18 of each of the doors 12. While the handles 20 may be mounted on the doors 12 in any convenience manner, a preferred attachment means as shown in FIGS. 4 and 5. The handles 12 each include upper and lower ends with recesses 22 therein adapted to receive mounting screws or bolts 24 which extend into the respective door 12, as best seen in FIG. 5. The recesses 22 are covered by pieces or caps 26, in accordance with the present invention. The caps 26 are selected from a group of caps having various colors, such that the consumer can choose the colors of caps 26 to match their personal preference. In other words, caps 26 are exchangeable with other similar caps having different colors, as selected by the consumer. The caps 26 snap fit into the recesses 22 and can be easily removed with a knife or similar flat blade for exchange with different colored caps.

Figure 2:
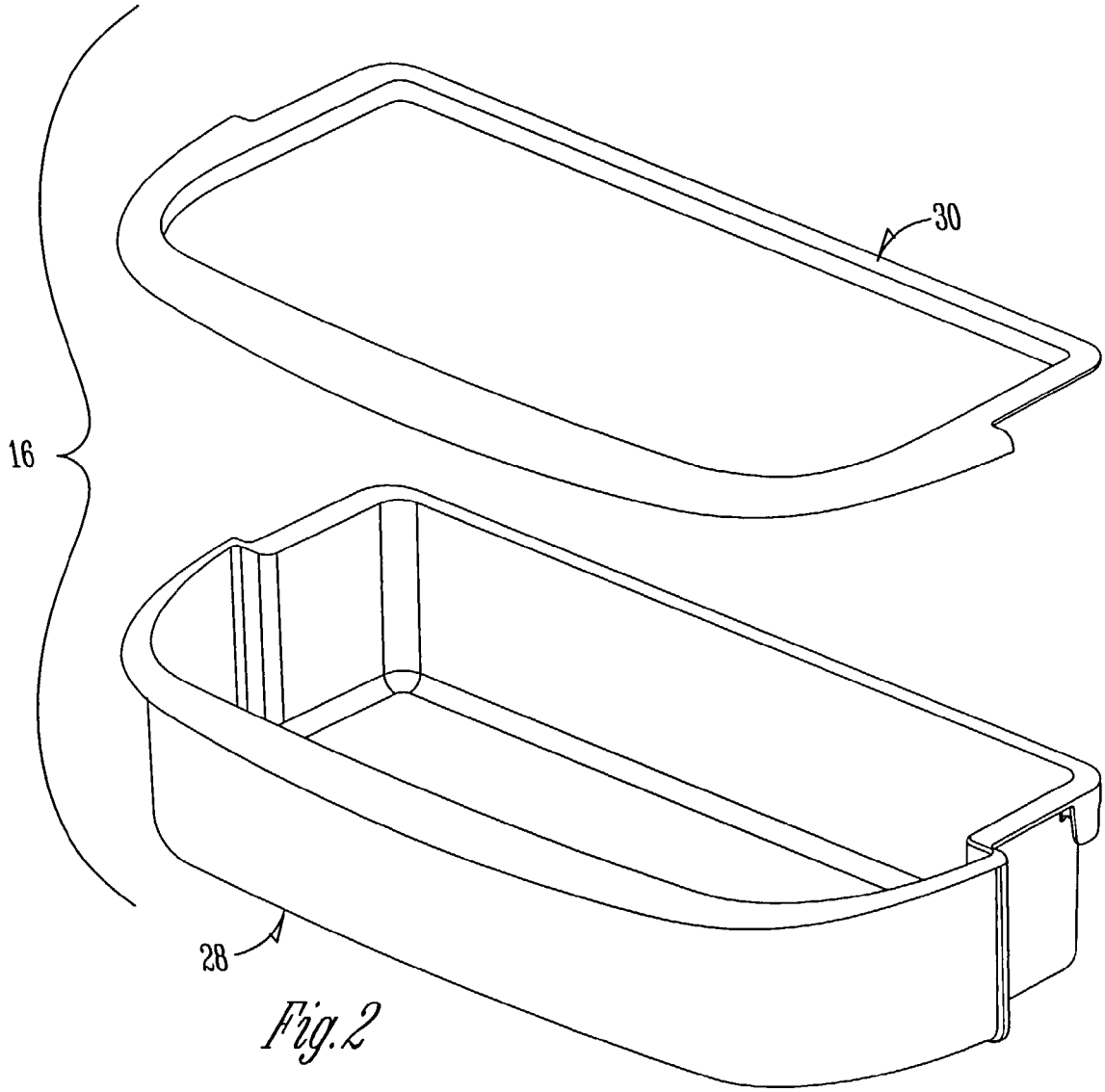
FIG. 2 is an exploded view of a storage bucket with the interchangeable colored trim piece.
Figure 3:
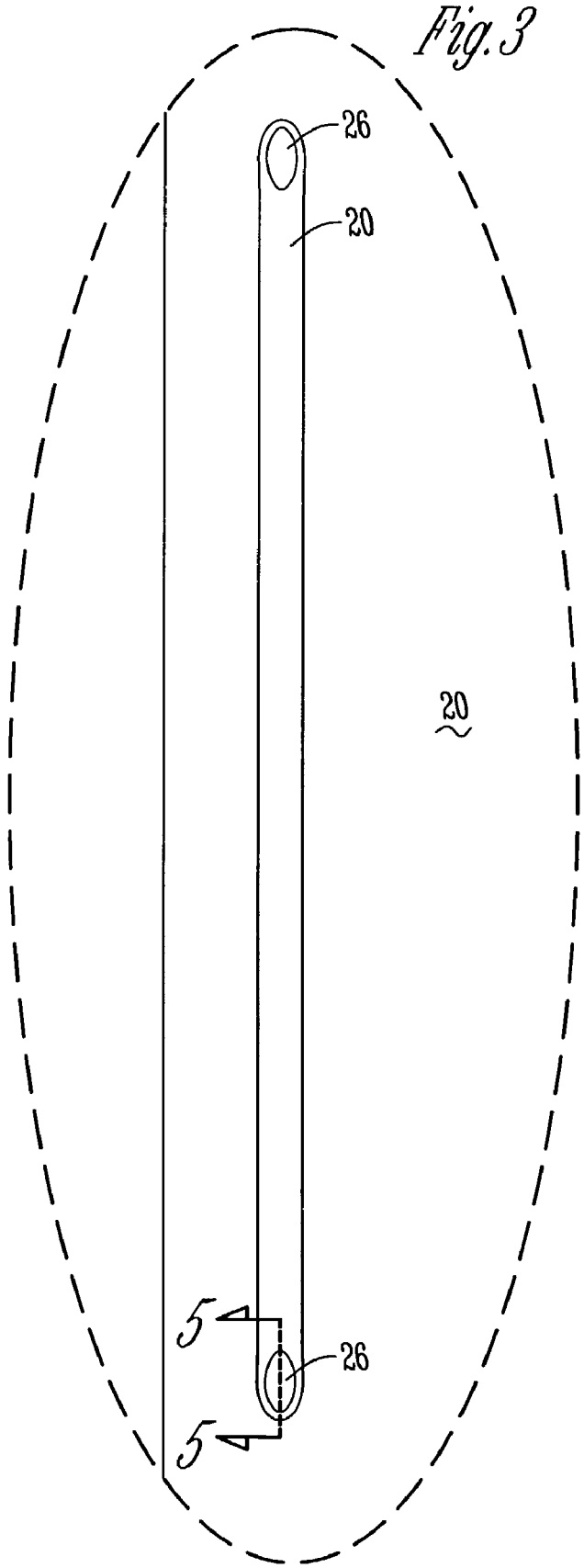
FIG. 3 is a front view of one of the refrigerator doors, showing the handle with the interchangeable colored caps.

The refrigerator 10 also includes storage buckets 28 mounted in at least one of the doors 12, as seen in FIG. 1. Each bucket 28 includes a colored trim piece 30, best shown in FIG. 2, which snap fits on to the upper edge of the bucket 28. As with the door handle caps 26, the bucket trim 30 is selected from a group of trim pieces having different colors. Thus, the colors of the bucket trim pieces can be mixed or matched with one another and with the door handle caps 26, as the consumer desires.

It is understood that the shelves 32 and storage bins or drawers 34 of the refrigerator 10 may also include colored edge pieces 36 or trim pieces 38, chosen from various colors by the consumer. The edge pieces 36 and the trim pieces 38 are preferably snap fit on the shelves 32 and drawers 34, respectively, for quick and easy exchange with different colored pieces.

The refrigerator 10 also includes a water dispenser 40 having an colored actuator button 42 and a colored sump tray 44. The actuator button 42 and tray 44 are also exchangeable with other buttons and trays having different colors.

Thus, the consumer can color coordinate the various colored pieces to match or coordinate with the surrounding decor.

It is understood that other easily removable pieces on the refrigerator 10 can be exchanged for different colors, such as door hinges, internal compartment doors, ice cube trays, ice cube bins, and the like.

It is also understood that similar color exchangeable pieces can be provided on other appliances, such as the handles, buttons, control knobs, and other trim or edge pieces of ovens and microwaves.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A refrigerator, comprising:

a food compartment;

a door mounted for movement between open and closed positions relative to the food compartment, and having interior and exterior surfaces;

a handle attachable to the exterior surface;

fasteners extending through the handle to attach the handle to the door;

colored caps for covering the fasteners;

the caps being exchangeable with other caps having different colors; and food storage buckets on the inside of the door, each bucket having a colored trim piece, the trim piece being exchangeable with other trim pieces having different colors.

2. The refrigerator of claim 1 further comprising a water dispenser with a colored sump tray, the tray being exchangeable with other sump trays having different colors.

3. The refrigerator of claim 2 wherein the water dispenser has a colored actuator button, the button being exchangeable with other actuator buttons having different colors.

4. The refrigerator of claim 1 further comprising a water dispenser with a colored sump tray, the tray being exchangeable with other trays having different colors.

5. The refrigerator of claim 4 wherein the water dispenser includes a colored actuator button, the button being exchangeable with other actuator buttons having different colors.

6. The refrigerator of claim 1 further comprising shelves with a colored trim piece, the trim piece being exchangeable with other trim pieces having a different color.

7. The refrigerator of claim 1 further comprising drawers having a colored trim piece, the trim piece being exchangeable with other trim pieces having a different color.

8. An improved refrigerator including a food compartment, a door, a handle on the door, storage buckets, shelves, and drawers inside the food compartment, and a water dispenser, the improvement comprising:

color-coordinated pieces on the door handle, buckets, shelves, drawers and water dispenser each being exchangeable with other pieces having different colors; and one of the pieces on the water dispenser is an actuator button.

9. The improved refrigerator of claim 8 wherein the pieces on the door handle are caps for covering fasteners attaching the handle to the door.

10. The improved refrigerator of claim 8 wherein the pieces on the buckets are trim pieces extending along a visually exposed edge of the bucket.

11. The improved refrigerator of claim 8 wherein another of the pieces on the water dispenser is a sump tray.

12. The improved refrigerator of claim 8 wherein the pieces on the shelves are edge trim pieces on a front edge of each shelf.

13. The improved refrigerator of claim 8 wherein the pieces on the drawers are trim pieces on a visually exposed portion of the drawer.

14. A refrigerator, comprising:

a food compartment;

a door mourned for movement between open and closed positions relative to the food compartment, and having interior and exterior surfaces;

a handle attachable to the exterior surface;

fasteners extending through the handle to attach the handle to the door;

colored caps for covering the fasteners;

the caps being exchangeable with other caps having different colors;

a water dispenser with a colored sump tray, the tray being exchangeable with other trays having different colors; and the water dispenser includes a colored actuator button, the button being exchangeable with other actuator buttons having different colors.

* * * * *